United States Patent [19]

Kuo

[11] 4,248,493

[45] Feb. 3, 1981

[54] SELF-LOCKING CLAMP MEMBER

[75] Inventor: Ted L. C. Kuo, Fanwood, N.J.

[73] Assignee: Thomas & Betts Corporation, Raritan, N.J.

[21] Appl. No.: 42,441

[22] Filed: May 25, 1979

[51] Int. Cl.[3] ..... H01R 4/10; H01R 4/00

[52] U.S. Cl. ..... 339/97 R; 339/276 R; 174/84 C

[58] Field of Search ..... 339/97 C, 97 R, 97 P, 339/97 L, 14 L, 276 R; 174/84 C; 85/11, 26; 24/30.5 W, 129 W, 265 A

[56] References Cited

U.S. PATENT DOCUMENTS

| | | | |
|---|---|---|---|
| 3,247,316 | 4/1966 | Weimer | 174/94 |
| 3,549,786 | 12/1970 | Kuo | 174/84 |
| 3,728,473 | 4/1973 | Kuo | 339/97 C X |
| 3,752,901 | 8/1973 | Kuo | 174/84 |
| 3,753,213 | 8/1973 | Frey | 339/97 R |
| 3,880,488 | 4/1975 | Collier | 339/97 C |
| 3,960,430 | 6/1976 | Bunnell | 339/97 C |
| 3,997,233 | 12/1976 | Evans | 339/97 C |
| 4,082,402 | 4/1978 | Kinkaid | 339/97 C |

*Primary Examiner*—John McQuade
*Assistant Examiner*—John S. Brown
*Attorney, Agent, or Firm*—James J. Daley; Robert M. Rodrick; Jesse Woldman

[57] ABSTRACT

A self-locking clamp member comprises a bendable member for bending along a bending line which divides the bendable member into first and second arm portions separated from one another by the bending line. The first arm portion includes a bendable tab extending away from the surface of the first arm portion and the second arm portion includes an opening for receiving the bendable tab and closing means associated with the opening for engaging the bendable tab to bend the tab when the tab enters the opening as the bendable member is bent along the bending to move the first and second arm portions towards one another.

16 Claims, 4 Drawing Figures

SELF-LOCKING CLAMP MEMBER

BACKGROUND OF THE INVENTION

The present invention relates to a clamp member, and more particularly to a self-locking clamp member which is particularly useful for clamping together and making electrical contact with the conductors of flat conductor cable.

Flat conductor cable was developed to replace present electrical systems or installations utilizing conduits buried in the floor or above the ceiling. The flat cables are intended to be placed flush to the floor surface with the necessary branch circuits leading to the desired locations with carpeting then being placed over the cable to provide a surface suitable for interior use and for personnel traffic. For example, with a system such as that contemplated in copending U.S. Application Ser. No. 042,544, filed on even date herewith, and entitled Multiconductor Cable, in which a plurality of separate flat conductor cables are adapted to be placed on the floor and extend in different directions, it is necessary to electrically connect the conductors of one flat conductor cable with those of another flat conductor cable. For this purpose, it is desired that the means for providing such electrical connection be simple in design, economical to produce and simple to install, while at the same time ensuring that good electrical contact is achieved and maintained.

One prior art technique for providing electrical connection to flat conductor cable is shown in U.S. Pat. No. 3,549,786. In that patent, the connector includes first and second halves which are bent to overlie one another and to receive the flat conductor cable therebetween. The two opposing surfaces of the first and second halves are each provided with a plurality of insulation piercing teeth which serve to pierce through the insulation surrounding the conductor to make electrical contact therewith. Both the upper and lower halves of the connector are provided with an opening therethrough for receiving a mechanical fastener to secure the connector and the cable to a suitable mounting surface, with the two halves being maintained in a closed contacting position by being sandwiched between the enlarged head of the fastening means and the mounting surface.

SUMMARY OF THE INVENTION

There is provided in accordance with the present invention a self-locking clamp member which is particularly useful for joining together in electrical contact conductors of two separate flat cables. However, it should be realized that the self-locking clamp member of the present invention is not limited to such use, but in fact may be used for a variety of different purposes and uses as will be apparent to those skilled in the art.

The self-locking clamp member of the present invention comprises a bendable member for bending along a bending line and which includes a first arm portion and a second arm portion separated from one another by the bending line. The first arm portion includes a bendable tab extending away from the surface of the first arm portion, and the second arm portion includes an opening for receiving the bendable tab and closing means associated with the opening for engaging the bendable tab to bend the tab when the tab enters the opening as the bendable members are bent along the bending line to move the first and second arm portions towards one another.

In a preferred embodiment, the first and second arm portions each have first and second opposite surfaces, and the first surfaces of the first and second arm portions oppose one another when the bendable member is bent along a bending line to move the first and second arm portions towards one another. With such an arrangement, the bendable tab extends away from the first surface of the first arm portion.

In a further preferred embodiment, the closing means comprises means for bending the tab in a manner such that at least a portion of the tab overlies a portion of the second surface of the second arm portion to hold the first and second arm portions in a closed locking position. In another aspect of the present invention, the closing means comprises means for changing the direction of travel of the tab as the tab enters the opening and travels between the first and second surfaces. In still another aspect, the opening extends through the second arm portion and the closing means comprises a hood on the second surface of the second arm portion which protrudes at least partially over the opening in blocking relationship thereto. The hood includes a camming surface which is inclined with respect to a direction normal to the second surface for bending the tab as the tab enters and passes through the opening.

In a preferred embodiment in which the clamp member is adapted for use in providing electrical connection with a conductor of a flat cable, insulation piercing teeth are provided on the first surfaces of the first and second arm portions for piercing through the insulation and making electrical contact with the conductor of a flat cable inserted between the first and second arm portions when the bendable member is bent along the bending line to move the first and second arm portions towards one another.

These and other features and characteristics of the present invention will be apparent from the following detailed description in which reference is made to the enclosing drawings which illustrate a preferred embodiment of the present invention.

DETAILED DESCRIPTION OF THE PREFERRED EMBODIMENT

Figure 1:
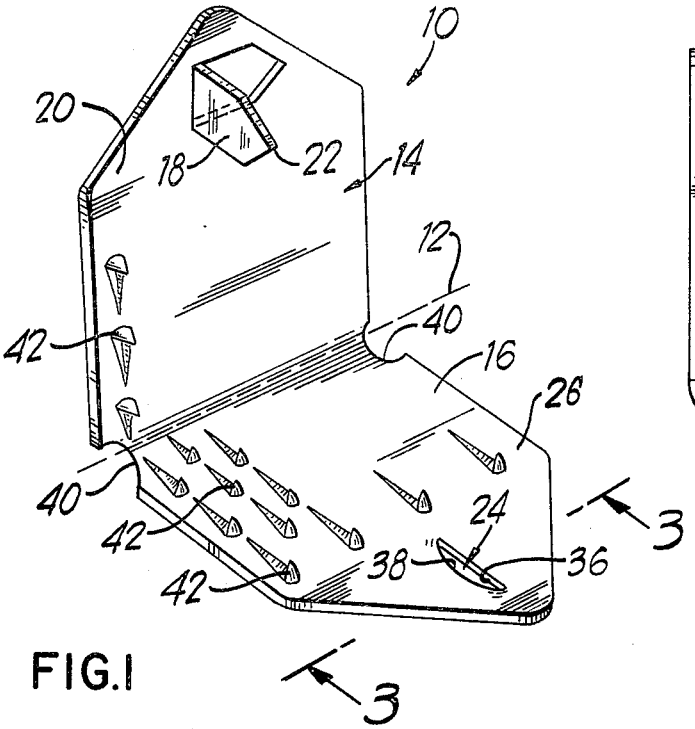
FIG. 1 is a perspective view of the self-locking clamp member in accordance with the present invention, showing the major components thereof.

Referring now to the drawings in which like reference characters represent like elements, there is shown in FIG. 1 a self-locking clamp member 10 in accordance with the present invention which is particularly useful for making electrical contact with the conductors of flat conductor cable. FIG. 1 shows the clamp member 10 as including a bendable member adapted to bend along a bending line 12 to define first and second arm portions 14, 16. In this preferred embodiment, the entire member 10 is metallic so as to be suitable for conducting electricity when the clamp member 10 is attached to and makes electrical contact with the conductor of flat conductor cable. However, as can be appreciated, if the clamp member 10 is used for a different purpose, any suitable material may be used. Also, although the first and second arm portions 14, 16 are each shown as being pentagonal in shape, it of course should be realized that other shapes could be used. In fact, the first and second arm portions 14, 16 need not be of the same shape.

The first arm portion 14 of the self-locking clamp member is provided with a bendable tab 18 which extends away from the surface 20 of the first arm portion 14. In the embodiment shown, the tab 18 has been punched or stamped out of the first arm portion 14, and also is of a pentagonal shape. The tab 18 has a sharp tip 22 for piercing of a flat conductor cable when the first and second arm portions 14, 16 are closed, as more fully described hereinbelow. The tab 18 is shown extending perpendicular to the bending line 12 of the clamp member 10 which gives it the greatest strength to resist bending of the tab 18 back to its original position, in surface 20 upon engagement with opening 24 but does not prevent proper folding of the tab 18. Tab 18 could also be positioned perpendicular to the present tab 18 position if strengthened by ribs to prevent unwanted folding, bending, etc. The opening 24 would then similarly be turned 90° from the position shown in FIG. 1.

The second arm portion 16 is provided with an opening 24 therethrough which is arranged with respect to the bending line 12 so as to be adapted to receive the tab 18 when the bendable member 10 is bent along the bending line 12 to move the first and second arm portions 14, 16 towards one another. As best seen in FIG. 1, in the surface 26 of the second arm portion, the opening 24 is elongated, having a longitudinal dimension substantially corresponding to the width of the tab 18. On the opposite surface 28 of the second arm portion 16, there is provided a closing means 30 for bending of the tab 18 when the first and second arm portions 14, 16 are moved together and the tab 18 enters and passes through the opening 24.

Figure 3:
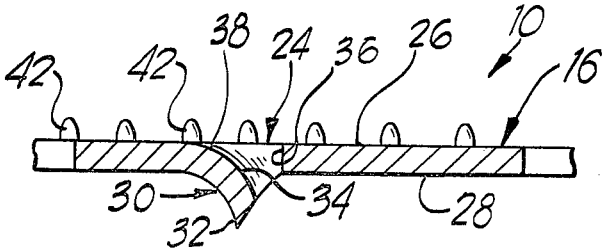
FIG. 3 is an enlarged end sectional view of the second arm portion, taken along lines 3—3 of FIG. 1, showing the opening therethrough and closing means thereof.

In the embodiment shown, this closing means 30 comprises a hood 32 which has been stamped or punched out of the second arm portion 16. As best seen in FIG. 3, the hood 32 overlies a portion of the opening 24 with the inner surface 34 being curved to provide a camming action to cause bending of the tab 18 when the two arm portions 14, 16 move together. In essence, this hood 32 and camming surface 34 serve to change the direction of travel of the tab 18 as the tab 18 enters and passes between the first and second surfaces 26, 28 of the second arm portion 16. Initially, the tab 18 enters the opening 24 substantially normal to the first surface 26 of the second arm portion 16 and the hood 32 and camming surface 34 cause the tab 18 to exit at an acute angle with respect to the second surface 28 of the second arm portion 16. Hood 32 also provides a further important function—namely, it compensates for manufacturing tolerance problems since the tab 18 may not be made consistently at 90° to the surface 20 by may vary. The hood 32 thus accepts a degree of misalignment that an unhooded slot could not.

Figure 2:
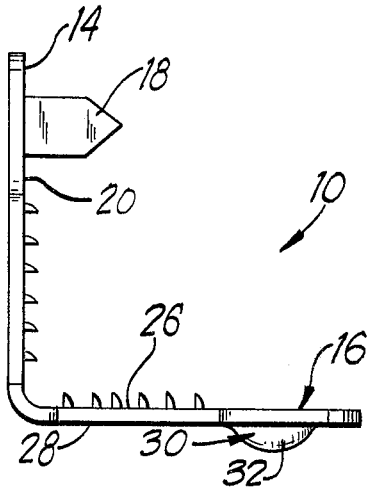
FIG. 2 is a side elevational view of the self-locking clamp member shown in FIG. 1.
Figure 4:
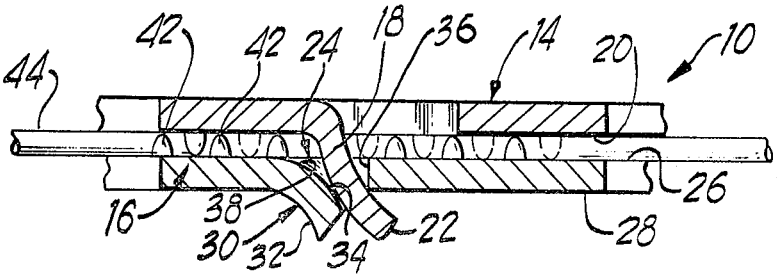
FIG. 4 is an enlarged end sectional view similar to that shown in FIG. 3, showing the first and second arm portions in the closed locking position with a flat conductor cable inserted therebetween.

As best seen in FIGS. 1 and 2, the elongated opening 24 in the second arm portion 16 includes a substantially straight edge 36 and a curved edge 38 terminating at the straight edge 36. Thus, the hood 32 is curved both laterally and longitudinally with respect to the opening 24 (see FIGS. 2 and 3). In this manner, as the tab 18 enters the opening and engages the hood 32, the tab 18 is bent into an arcuate shape so that it overlies a portion of the straight edge 36 in the second surface 28 of the second arm portion 16, as shown in FIG. 4, to hold the first and second arm portions 14, 16 in the closed clamping position. As can be appreciated, the extent that the hood 32 overlies the opening 24 controls the extent of bending of the tab 18, and thus the extent that the tab 18 will overlie the straight edge section 36 of the opening 24 at the second surface 28 of the second arm portion 16. It should further be noted that the size of the opening 24 at the second surface 28 between the camming surface 34 of the hood and the straight edge 36 of the opening 24 substantially corresponds to the thickness of the tab 18 so that the tab 18 is guided precisely therethrough.

It should also be noted that in order to provide for proper alignment of the tab 18 with the opening 24, the tab 18 and opening 24 are properly positioned at equal distances from the bending line 12 so that the tab 18 will be received within the opening 24 when the bendable member 10 is bent along the bending line 12. To facilitate precision bending of the first and second arm portions 14, 16, about the bending line 12, cutouts 40 are provided to reduce the cross-sectional area along the line 12. In effect, these cutouts 40 reduce bending forces with respect to the cross-sectional area at the bending line 12 and ensure that complete bending will take place at the desired location.

It should also be noted that the tab 18 and corresponding opening 24 for receiving same are preferably located at a substantial distance from the bending line 12 so that the first and second arm portions 14, 16 will lie substantially flat, one over the other, when the two arm portions 14, 16 are brought together and held in place. That is, by placing of the tab 18 and the opening 24 at the extremities of the first and second arm portions 14, 16 away from the bending line 12, the first and second arm portions 14, 16 will be substantially flat and overlie one another when the bendable member is in its closed clamping position.

As the self-locking clamp member 10 of the present invention is particularly useful for making electrical contact with the conductor of flat conductor cable, a plurality of insulation piercing teeth 42 are provided on each of the surfaces 20, 26 of the first and second arm portions 14, 16 which are adapted to pierce the insulation surrounding the conductor of the flat conductor cable when the clamp member 10 is secured to such cable. Such insulation piercing teeth or members 42 may be of the conventional type, such as for example shown in U.S. Pat. No. 3,549,786. As that patent discloses, the teeth 42 may be skived or struck from the surface of the first and second arm portions 14, 16 in a manner to harden them to ensure good mechanical strength.

The position of the first and second arm portions 14, 16 before installation of the clamp member 10 onto flat conductor cable or cables is shown in FIG. 2, in which the first and second arm portions 14, 16 are substantially at right angles to one another. To install the clamp member 10 onto the flat conductor cable 44, the cable 44 (see FIG. 4) is inserted between first and second arm portions 14, 16 so that the tab 18 is located on one side of the flat conductor cable 44 and the opening 24 for receiving the tab 18 is located on the opposite side. As the first and second arm portions 14, 16 are moved closer together (with the use of a suitable tool for accomplishing the bending), the sharp end or tip 22 of the tab 18 first contacts the flat conductor cable 44 and cuts or shears through same as the tip 22 of the tab 18 begins to enter the opening 24 in the second arm portion 16.

Further closing of the first and second arm portions 14, 16 towards one another brings the tip 22 into contact with the camming surface 34 of the hood 32, which causes deflection of the tab 18 to bend the tab 18 through the opening 24 between the straight edge 36 on the second surface 28 and the cam surface 34 so that a portion of the tab 18 will overlie the second surface 28 adjacent the opening 24 to lock the first and second arm portions 14, 16 together (see FIG. 4). As can be appreciated, because a portion of the tab 18 overlies the second surface 28 of the second arm portion 16 adjacent the edge of the opening 24, the first and second arm portions 14, 16 will be restrained against unbending.

As can be seen in FIG. 4, which shows a single flat conductor cable 44 inserted between the first and second arm portions 14, 16, the insulation piercing teeth 42 pierce through the insulation surrounding the conductor and intimately engage the conductor in electrical contact with one another. Thus, the clamp member 10 is secured onto the flat conductor cable 44 and retained in place by virtue of the tab 18 bent along the second surface 28 of the second arm portion 16, with good electrical contact being made by the insulation piercing teeth 42 and by the tab 18 which is also pierced through the insulation and the conductor of the flat conductor cable 44.

Although not shown, it should be noted that two or more flat conductor cables could be inserted between the first and second arm portions 14, 16 of the clamp member 10 and both then mechanically and electrically connected together with use of the self-locking clamp member 10 of the present invention. For example, the conductors of the two flat cables could be arranged at an angle with respect to one another and provided with an opening therethrough through which one of the arm portions 14, 16 of the clamp member 10 could be inserted. The clamp member 10 is then bent into the closed position to clamp the two cables therebetween. Alternatively, the clamp member 10 could engage the edges of the overlying flat conductor cables and bent along the bending line 12 to mechanically secure the two flat conductor cables together and to make electrical contact with the conductors of each to provide an electrical connection. With either of these arrangements, at least the insulation piercing teeth 42 on the first arm portion 14 would pierce through the insulation and make contact with a conductor of one of the flat cables and at least the insulation piercing teeth 42 on the second arm portion would pierce through the insulation and make electrical contact with a conductor of the other flat cable. Depending on the thickness of the flat cable, it should of course be realized that the insulation piercing teeth 42 on both the first and second arm portions 14, 16 may electrically contact the conductors of both of the flat cables when the clamp member is insulated therein. Such a use of the clamp member 10 for example is shown in copending U.S. Application Ser. No. 042,440, entitled Method For Electrical Connection of Flat Cables.

Thus, it is seen that in accordance with the present invention, there is provided a self-locking clamp member 10 which is particularly useful for providing electrical connection to conductors of flat conductor cable. The self-locking clamp member 10 is simple in design, and simply and easily installed in place on flat conductor cable. Further, by virtue of the cooperation of the closing means 30 and the bendable tab 18, once the clamp member 10 is installed in place, by bending the first and second arm portions 14, 16 together it will be retained thereinplace by virtue of the first and second arm portions 14, 16 being locked or held together by virtue of the tab 18 being bent to overlie a portion of the outside surface 28 of the second arm portion 16.

Stated another way, clamp 10 is made up of a plate member having a first plate surface 20 and a second plate surface 28 bendable about a bending axis 12 to form a first sector 14 and a second sector 16. Distant a first distance from the bending axis 12, at a first location, is an opening 24. Distant a second distance from the bending axis 12, at a second location, and registerable with the first location when the plate member is bent about bending axis 12 is a cable piercing means 18 carrier or supported by the plate member and extending outwardly from first plate surface 20. Adjacent the opening 24, supported by the plate member on the second plate surface 28 and facing opening 24 is a deforming means or hood 32 having an inner camming surface 34 to deform the cable piercing means 18 to overlie a portion of the second plate surface 28 as the cable piercing means 18 enters opening 24 upon the bending of the plate member about bending axis 12 to retain the clamp 10 in its closed condition upon one or more flat conductor cables placed adjacent first and second sectors respectively. Cable insulation means or teeth 42 pierce the insulation about the flat conductors and make electrical contact with the metal of the conductors to establish a conductive path between the conductors of two or more flat conductor cables placed within said clamp 10 via the cable piercing means 42 and the plate member.

While the preferred embodiment of the present invention has been shown and described, it will be understood that such are merely illustrative and that changes may be made without departing from the scope of the invention as claimed.

What is claimed is:

1. A self-locking clamp member comprising:

a bendable member for bending along a bending line, said bendable member including a first arm portion and a second arm portion separated from one another by said bending line;

said first arm portion including a bendable tab extending away from the surface of said first arm portion; and said second arm portion including an opening for receiving said bendable tab and closing means having a surface portion merging with a surface portion of said opening for engaging said bendable tab to bend said bendable tab when said tab enters said opening as said bendable member is bent along said bending line to move said first and second arm portions towards one another.

2. The self-locking clamp member of claim 1 wherein said first and second arm portions each include first and second opposite surfaces, said first surfaces of said first and second arm portions opposing one another when said first and second arm portions are moved towards one another, and wherein said bendable tab extends away from said first surface of said first arm portion.

3. The self-locking clamp member of claim 2 wherein said closing means comprises means for bending said tab so that at least a portion of said tab overlies a portion of said second surface of said second arm portion to hold said first and second arm portions in a closed locking position.

4. The self-locking clamp member of claim 2 wherein said closing means comprises means for changing the direction of travel of said tab as said tab enters said opening and travels between said first and second surfaces of said second arm portion when said bendable member is bent along said bending line.

5. The self-locking clamp member of claim 2 wherein said opening extends through said second arm portion and wherein said closing means comprises a hood on said second surface of said second arm portion, said hood protruding at least partially over said opening and said hood having a camming surface inclined with respect to a direction normal to said second surface of said second arm portion.

6. The self-locking clamp member of claim 5 wherein said camming surface is inclined in such a manner so as to cause said bendable tab to bend to overlie a portion of said second surface of said second arm portion adjacent said opening as said tab passes through said opening to lock said first and second arm portions together.

7. The self-locking clamp member of claim 2 further including electrical contact means for making electrical contact with a conductor inserted between said first and second arm portions as said bendable member is bent along said bending line.

8. The self-locking clamp member of claim 1 wherein said bendable member includes cutouts along said bending line to facilitate bending therealong.

9. A clamp for connection with flat conductor cable of the type having enclosing electrical insulation thereabout, comprising:

a plate member having first and second spaced apart opposed plate surfaces and bendable about a bending axis therein, said plate member defining an opening therethrough extending between said first and second plate surfaces at a first location distal from said bending axis;

cable piercing means carried by said plate member and extending outwardly of said first plate surface at a second location distal from said bending axis and registrable with said opening at said first location upon the bending of said plate member about said bending axis; and deforming means on said plate member having a surface portion defining a wall portion of said opening for deforming said cable piercing means on said bending of said plate member.

10. A clamp as defined in claim 9, further including cable insulation piercing means carried by said plate member and extending outwardly of said plate member first plate surface.

11. A clamp as defined in claim 10 wherein said plate member, said cable piercing means and said insulation piercing means are constituted by integral sheet material.

12. A clamp as defined in claim 10 wherein said plate member, said cable piercing means, said insulation piercing means and said deforming means are constituted by integral sheet material.

13. A clamp as defined in claim 9, wherein said deforming means comprises means for deforming said cable piercing means so that at least a portion of said cable piercing means overlies a portion of said second plate surface to hold said plate member in its bent relationship.

14. A clamp as defined in claim 9, wherein said deforming means comprises means for changing the direction of travel of said cable piercing means as said cable piercing means enters said opening and travels between said first and second plate surfaces upon the bending of a said plate member.

15. A clamp as defined in claim 9, wherein said deforming means comprises a hood on said second plate surface of said plate member, said hood protruding at least partially over said opening and said hood having a camming surface inclined with respect to the direction normal to said second plate surface of said plate member.

16. A clamp as defined in claim 15, wherein said camming surface is inclined in such a manner so as to cause said cable piercing means to bend to overlie a portion of said second plate surface adjacent said opening as said cable piercing means passes through said opening to lock said plate member in its bent relationship.

* * * * *